United States Patent [19]

Peterson

[11] Patent Number: 5,020,988

[45] Date of Patent: Jun. 4, 1991

[54] INTERMITTENT PILOT TYPE BURNER CONTROL WITH A SINGLE CONTROL RELAY

[75] Inventor: Scott M. Peterson, Eden Praire, Minn.

[73] Assignee: Honeywell Inc., Minneapolis, Minn.

[21] Appl. No.: 600,791

[22] Filed: Oct. 22, 1990

[51] Int. Cl.[5] ..... F23Q 9/08

[52] U.S. Cl. ..... 431/51; 431/46; 431/54

[58] Field of Search ..... 431/27, 46, 51, 54, 431/55

[56] References Cited

U.S. PATENT DOCUMENTS

| | | | |
|---|---|---|---|
| 3,282,324 | 11/1966 | Romanelli . | |
| 4,360,338 | 11/1982 | Katchka | 431/46 |
| 4,435,150 | 3/1984 | Rippelmeyer | 431/46 |
| 4,689,006 | 8/1987 | Gann | 431/46 |
| 4,806,095 | 2/1989 | Goldstein et al. | 431/54 |

*Primary Examiner*—Carroll B. Dority
*Attorney, Agent, or Firm*—Edward Schwarz

[57] ABSTRACT

A burner control system for an intermittent pilot burner system uses a single pole double throw relay to control first and second electromagnetic valves respectively supplying fuel for both burners and for the main burner only. The normally open contact pair supplies the current for the first and the normally closed contact pair supplies the current for the second valve. By selecting the valve supplying fuel for both burners to be of the type which has an appreciably higher pull-in current than drop-out current, and by shunting the relay's normally open contacts with a properly selected resistor, only a single relay is necessary. This resistor is selected to supply current sufficient to hold the valve open (current greater than the drop-out value) after the valve has received pull-in current through the closing of these normally open contacts, but insufficient to open the valve. Use of a single relay reduces cost, size, and power, and increases safety of the control system.

4 Claims, 1 Drawing Sheet

INTERMITTENT PILOT TYPE BURNER CONTROL WITH A SINGLE CONTROL RELAY

BACKGROUND OF THE INVENTION

Newer designs for burner controls, such as those which heat residences, typically burn natural gas or oil as fuel. Because of the ever-increasing cost of fuels, the use of standing pilots for ignition when heat is demanded is falling out of favor. In the place of such standing pilots for lighting the main burner is either some type of direct ignition device, or an intermittent pilot burner which is relit each time there is a demand for heat. The latter design has advantages since it is typically easier to light the relatively small quantity of pilot burner fuel than the larger amount of main burner fuel, even if the main burner valve is modulated to reduce the amount of fuel which flows during ignition. It has always been relatively easy to reliably light a main burner from a pilot flame.

To assure that fuel cannot flow to the main burner until there is a pilot flame, it is customary to condition opening the main burner valve on presence of a pilot flame. To further increase safety of operation, dual redundancy is introduced into the valve design controlling the main burner fuel flow. This is accomplished with a pilot valve which controls flow of fuel to both the pilot and main valves and a main valve which controls flow of fuel to the main valve only, hence its name as the "main" (burner) valve. It is particularly important that the main valve not be open unless the pilot flame is present, since flow of main burner fuel without combustion quickly accumulates a large amount of unburned fuel which can cause an explosion or asphyxiation. In this preferred design, one can see that failure of either valve in the open position, which may be either a control problem or a problem with the valve itself, does not per se result in flow of fuel to the main burner. Even if the pilot valve fails to shut completely, the substantially lesser amount of pilot burner fuel which flows compared to the main burner flow, results in substantially less risk of harm. And if the main valve fails to close, the pilot valve prevents flow of fuel to the main burner unless fuel is also flowing to the pilot burner, which will usually light promptly to establish main burner ignition and thereby avoid a dangerous situation.

A disadvantage of this system, however, is the fact that heretofore at least two relays have been required to control these two valves. Since relays are expensive this adds cost to the system. Further, since relays are components which are inherently less reliable than other of the components which make up a burner control, each additional relay is one more opportunity for the system to fail. Relays usually fail by welding of their contacts in the closed position, meaning that current flows through the contacts even after the current flow to the control winding has ceased. To avoid the dangers inherent in this situation, it has been the practice to test the condition of the relay contacts and shut down the system if a relay contact is closed when it should be open according to the state of current flow to the control winding. But such an expedient results in additional complexity and expense of the system.

BRIEF DESCRIPTION OF THE INVENTION

A burner control system for use in a system of the type having a pilot burner with an intermittent flame, a main burner, a first electrically controlled valve for controlling flow of fuel for the pilot and main burner, and a second electrically controlled valve in series flow connection with the first valve for controlling flow of main burner fuel only has only a single relay controlling both valves. To allow this improvement, the first valve must be one of the type having a pull-in current appreciably greater than the drop-out current, that is, the valve requires substantially greater current to open it than to hold it open. The part of the circuit which controls position of the first valve comprises two elements. The first is a single pole double throw (SPDT) relay whose normally open contact pair controls electrical power to the first valve. The second element is a resistor shunting the relay's normally open contact pair, said resistor of value allowing current flow to the first valve greater than the drop-out current for the first valve and less than the pull-in current for the first valve, when the normally open contact pair is open. The normally closed contact pair controls power to the second valve. Typically, the common contact of the relay contacts receives power from the thermostat or other type of switch.

When the thermostat contacts close, current flows to the common relay contact and to the relay winding and the normally open contact pair closes. Power is supplied to the first valve through the thermostat and the now-closed normally open contact pair. The first valve opens to allow fuel to flow to the pilot light so it can ignite, and also to flow to the second valve. When the pilot light has lit, then power is removed from the relay winding to open the normally open contacts and close the normally closed contacts, which allows the second valve to open. Because of the resistor shunting the normally open contacts, sufficient current flows to the first valve to maintain it open. Fuel can therefore flow through both of the valves to the main burner, where the pilot flame ignites it. Without this startup sequence however, the second valve will not open, so that even if the thermostat contacts conduct, fuel cannot flow to the main burner.

Accordingly, one purpose of this invention is to allow a single relay of the single pole, double throw type to control the pilot and main valves of an intermittent pilot flame burner A second purpose is to provide dual valve redundancy for controlling flow of fuel to the main burner.

BRIEF DESCRIPTION OF THE DRAWING

The FIGURE is a block circuit diagram of a burner control system incorporating the invention.

DESCRIPTION OF THE PREFERRED EMBODIMENT

Figure 1:
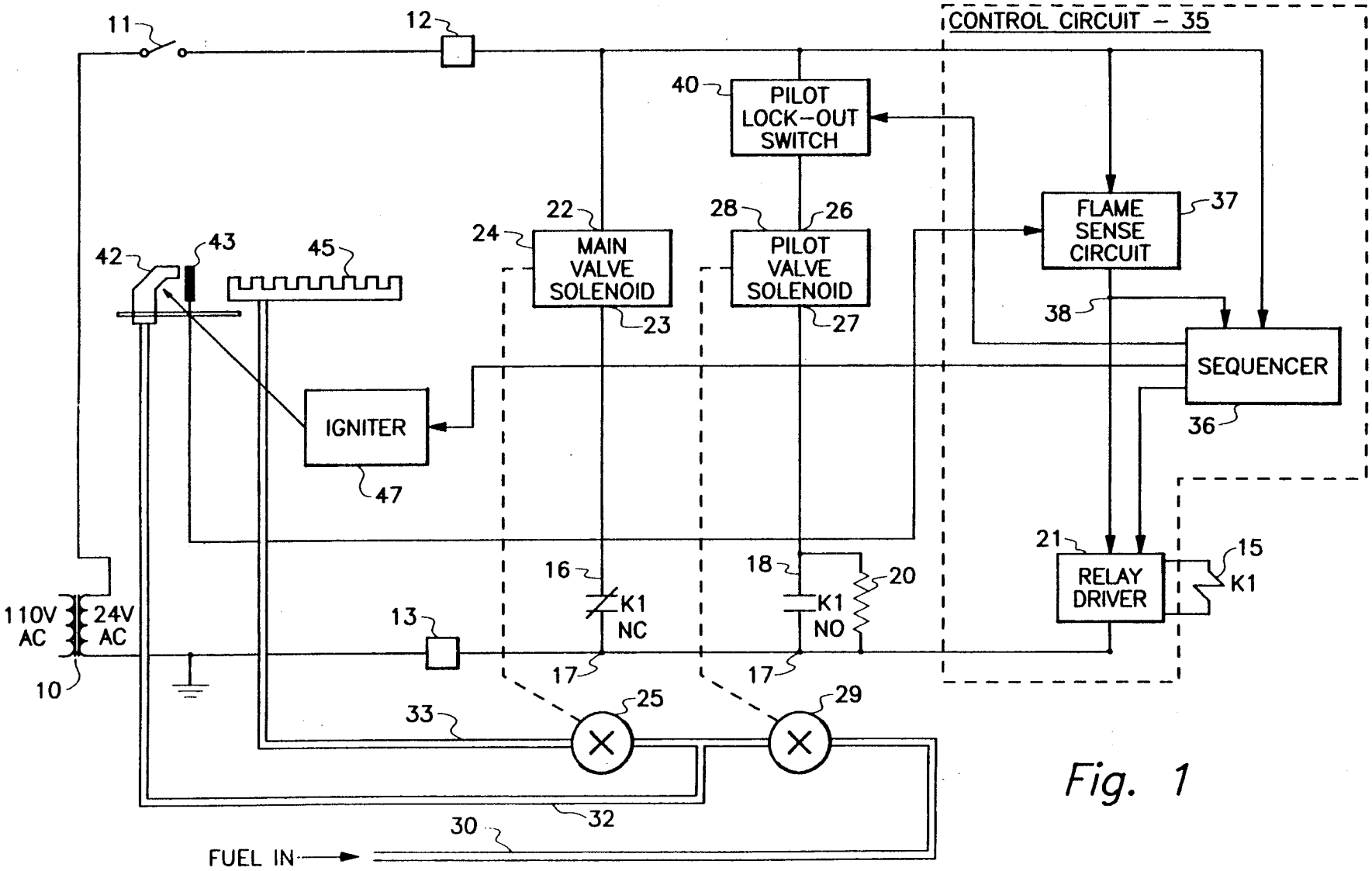

The FIGURE shows a burner control system incorporating the invention. A transformer 10 receives 110 VAC at its primary winding and provides for the typical design, a standard 24 VAC control voltage output at its secondary winding. The 24 VAC power is provided to terminals 12 and 13, with a switch 11, typically a thermostat, controlling power to these terminals. The control voltage also provides the power allowing the control system to function.

Fuel which may be natural gas is provided under pressure to the inlet of a fuel supply pipe 30 which is connected to the inlet of a first or pilot valve 29. The condition (whether open or closed) of pilot valve 29 is controlled by a pilot valve actuator or solenoid 28 as indicated by the dotted line connection between them. When power is applied through control terminals 26 and 27 to solenoid 28, valve 29 is held continuously open and fuel can flow through it. When power is not applied to solenoid 28 then valve 29 is closed. The outlet port of valve 29 is connected to the inlet port of a second or main valve 25 and also to a pipe 32 which carries fuel to pilot burner 42, hence the designation "pilot" valve for valve 29. Valve 25 controls flow of fuel to the main burner only through pipe 33. Valve 25 is also shown as having a solenoid 24 which controls the condition of valve 25 as indicated by the dotted line connection between them. Power applied to control terminals 22 and 23 holds valve 25 open continuously, and when power is removed, the valve immediately closes. In a common design, the two valves 25 and 29 and their actuators or solenoids 24 and 26, as well as the tee junction for pipe 32 between them, is combined within a single valve body.

Valve 29 must be one of the type having a pull-in current appreciably greater than its drop-out current. That is, one must apply substantially greater current to open valve 29 than is required to keep valve 29 open. Such valves for control of gaseous fuel flow are commonly available from various vendors. For example the Honeywell VR8204 gas valve currently available has a pull-in current on the order of 0.4 amp., and a drop-out current on the order of 0.05 amp.

Power to solenoids 24 and 26 is under the control of a K1 relay having a winding 15 and two contact pairs which share a common contact 17. The contact pair comprising contacts 16 and 17 is normally closed so that current flows through this contact pair to solenoid 24 when winding 15 is not energized. The contact pair comprising contact 18 and common contact 17 is normally open which means that current does not flow through this contact pair and through solenoid 28 when winding 15 is not energized. The contact pair comprising contacts 17 and 18 forms a shunt circuit with a resistor 20 shown shunting contacts 17 and 18 so that current will flow through resistor 20 to solenoid 28 even when the contact pair 17 and 18 is open. Resistor 20 must be chosen to allow flow to pilot valve solenoid 28 of a hold current whose value is between the drop-out current and pull-in current of the valve 29. This is an important aspect of the invention, and is required in order to control both valves 25 and 29 with a single SPDT relay. Ideally, resistor 20 has a value allowing current of approximately the maximum drop-out current for valve 29 plus one-half the difference between the minimum pull-in and maximum drop-out currents for valve 29 to flow to valve 29. Since these pull-in and drop-out currents may vary from valve unit to valve unit, these minimum pull-in and maximum drop-out currents should be determined by averaging the actual values for a number of units.

Power to pilot valve solenoid 28 is further controlled by a pilot lock-out switch 40 which is in series with the shunt circuit (relay contacts 17 and 18 and resistor 20) and the solenoid 28. The lock-out switch 40 is used to interrupt the flow of current to solenoid 28 in abnormal circumstances where the attempts to light pilot burner 42 have been unsuccessful. For the remainder of the discussion, switch 40 may be considered to be closed at all times during operation of the control system. Since switch 40 operates only in such abnormal circumstances, it typically will have a lower service rating. The lockout switch 40 is not a part of the invention per se.

Power to relay winding 15 and igniter 47 is under the general control of a control circuit 35. Control circuit 35 includes a sequencer 36 which is activated to run through a prescribed sequence of operations when switch or thermostat 11 closes placing the power voltage across power terminals 12 and 13. Flame sense circuit 37 and relay driver 21 may also be considered to be part of control circuit 35 as is shown.

Initially, both valves 25 and 29 in the FIGURE may be considered to be closed. When the power voltage is applied to control circuit 35, sequencer 36 provides power to relay driver 21 which energizes winding 15. As mentioned above, lock-out switch 40 may be considered to be closed during normal operation of the control system. When winding 15 is energized, the contact pair comprising contacts 17 and 18 closes and the contact pair comprising contacts 16 and 17 opens. With contacts 17 and 18 and lock-out switch 40 both closed, the power voltage at terminals 12 and 13 is applied across terminals 26 and 27 of pilot valve solenoid 28 energizing it. At the same time, main valve 25 closes because the normally closed contact pair comprising contacts 16 and 17 has opened, removing power from the main valve solenoid 24.

Before the opening of pilot valve 29, sequencer 36 provides power to an igniter 47 which causes fuel flowing from pilot burner 42 to ignite, as is signified by the arrow directed from igniter 47 to pilot burner 42. My copending patent application entitled Fuel Burner Having an Intermittent Pilot With Pre-Ignition Testing and filed on the same date as this application describes apparatus particularly well suited for controlling the process for establishing the pilot flame. As explained in that application, the igniter 47 may be of the so-called hot surface type which has a element through which current is passed to raise it to a temperature sufficient to ignite the fuel, or may be a spark igniter. Both of these types of devices are well known in the art.

Once a pilot flame is established a flame sensor 43 juxtaposed to the pilot burner 42 provides a pilot signal to a flame sense circuit 37. In response to the pilot signal, flame sense circuit 37 provides a signal to relay driver 21 directing driver 21 to de-energize relay wining 15. With winding 15 de-energized, the contact pair comprising contacts 16 and 17 close and main valve solenoid 24 receives power again from terminals 12 and 13, opening main valve 25. At the same time that contact pair 16 and 17 closes, the normally open contact pair comprising contacts 17 and 18 opens. Where normally opening of contact pair 17 and 18 would cause power to be removed from solenoid 28 and pilot valve 29 thus to close, instead resistor 20 shunts sufficient current across the open pair of contacts 17 and 18 to solenoid 28 to maintain valve 29 open. Therefore, fuel continues to flow through valve 29 downstream to valve 25 and thence through pipe 33 to main burner 45. Under normal circumstances, main burner 45 continues to operate for so long as switch 11 is closed. When switch 11 opens then power is completely removed from solenoids 24 and 28 causing both valves 25 and 29 to close and both pilot burner 42 and main burner 45 flames to go out.

If for some reason fuel supply is interrupted while the main burner 45 is operating, then flame sensor 43 changes the state of the pilot signal to indicate this condition to flame sense circuit 37. Flame sense circuit 37 then provides a signal on path 38 causing relay driver 21 to energize winding 15, opening contact pair 16 and 17, de-energizing main valve solenoid 24, and closing main valve 25. At the same time, pilot valve solenoid 28 becomes energized again through contact pair 17 and 18 so that relighting can occur. The flame signal from flame sense circuit 37 is applied to sequencer 36 to permit restarting of the ignition and operation cycle.

What I wish to claim by letters patent is:

1. In a burner control system for use in a system of the type having a pilot burner with an intermittent flame, a main burner, a first electrically controlled valve having first and second control terminals for controlling flow of fuel for the pilot and main burner, and a second electrically controlled valve having first and second control terminals, said second valve in series fuel flow connection with and downstream of the first valve for controlling flow of main burner fuel only, improved valve control apparatus wherein the first valve is one of the type having a pull-in current appreciably greater than the valve's drop-out current, comprising a) a single pole double throw relay having a normally open contact pair controlling electrical power to the first valve and a normally closed contact pair controlling power to the second valve; and b) a resistor shunting the relay's normally open contact pair, said resistor of value allowing current flow to the first valve greater than the drop-out current for the first valve and less than the pull-in current for the first valve, when the normally open contact pair is open.

2. The burner control system of claim 1, wherein the resistor has a value allowing current of approximately the drop-out current for the first valve plus one-half the difference between the pull-in and drop-out currents for the first valve.

3. The burner control system of claim 1 including first and second power terminals to which power is applied when a demand for heat is present, and further comprising a) a pilot flame sensor providing a pilot signal responsive to presence of a pilot flame; and b) control circuit means receiving power from the power terminals and receiving the pilot signal, for applying power to a winding of the relay upon first receiving power from the power terminals, and for removing power from the relay terminals responsive to the pilot signal.

4. The burner control system of claim 3, wherein the relay includes a common contact receiving power from the first .power terminal, a normally open contact which is electrically connected to the common contact when power is applied to the relay winding and a normally closed contact which is electrically connected to the common contact when power is absent from the relay winding, wherein the first control terminals of the first and second valves are connected to the second power terminal and the second control terminals of the first and second valves are connected to the normally open and normally closed relay contacts respectively.

* * * * *